US005385458A

United States Patent [19]

Chu

[11] Patent Number: 5,385,458

[45] Date of Patent: Jan. 31, 1995

[54] VANE-TYPE ROTARY COMPRESSOR

[76] Inventor: Jen Y. Chu, 75-2, Feng Jen Street, Chi-Loong, Taiwan, Prov. of China

[21] Appl. No.: 196,547

[22] Filed: Feb. 15, 1994

[51] Int. Cl.[6] ..... F04C 18/00

[52] U.S. Cl. ..... 418/255; 418/257

[58] Field of Search ..... 418/254, 255, 257

[56] References Cited

U.S. PATENT DOCUMENTS

| | | | |
|---|---|---|---|
| 630,590 | 8/1899 | Cathcart | 418/255 |
| 748,254 | 1/1904 | Guindon | 418/254 |
| 5,181,490 | 1/1993 | Ruzic | 418/255 |

*Primary Examiner*—Richard A. Bertsch
*Assistant Examiner*—Charles G. Freay
*Attorney, Agent, or Firm*—Morton J. Rosenberg; David I. Klein

[57] ABSTRACT

An improved vane-type rotary compressor includes a rotor which is constructed by four similar plates having evenly spaced slots and containing three sets of links with hooks and pistons in their central sleeves, and four vanes which are engaged with the hooks of the links and slidably mounted in the slots of the rotor while the edges of every vanes are lightly contacting with the inner surface of the cylinder having a gas inlet and a gas outlet of the compressor. The slidable vanes accompanying with the pistons in the sleeves of the links can reduce the contacting force of the vanes against the cylinder during the rotation to prolong the life of the vanes and to prevent the vanes from wear.

1 Claim, 5 Drawing Sheets

VANE-TYPE ROTARY COMPRESSOR

FIELD AND BACKGROUND OF THE INVENTION

The conventional vane-type rotary compressor works by the use of a centrifugal force on each vane which is mounted slidably on the rotor. During the rotating, the outer edge of the vanes is outwardly forced against the inner surface of the cylinder and moves in a high speed. If there is without lubricant, the vanes in such high rotating speed will be immediately damaged. Such prior system is as the U.S. Pat. No. 4,877,384.

SUMMARY OF THE INVENTION

It is the purpose of this invention to mitigate and obviate the above-mentioned drawbacks in the manner set forth in the detailed description of the preferred embodiment.

A primary objective of the present invention is to provide an improved vane-type rotary compressor which can reduce the contacting force of the vanes against the cylinder during the rotation to prolong the life of the vanes.

Another objective of the present invention is to provide the compressor which can be used without lubricant and effectively reduce the friction resistance and power.

Further objectives and advantages of the present invention will become apparent from the following detailed description when considered in connection with the accompanying drawings wherein:

DETAILED DESCRIPTION OF THE PREFERRED EMBODIMENT

Figure 1:
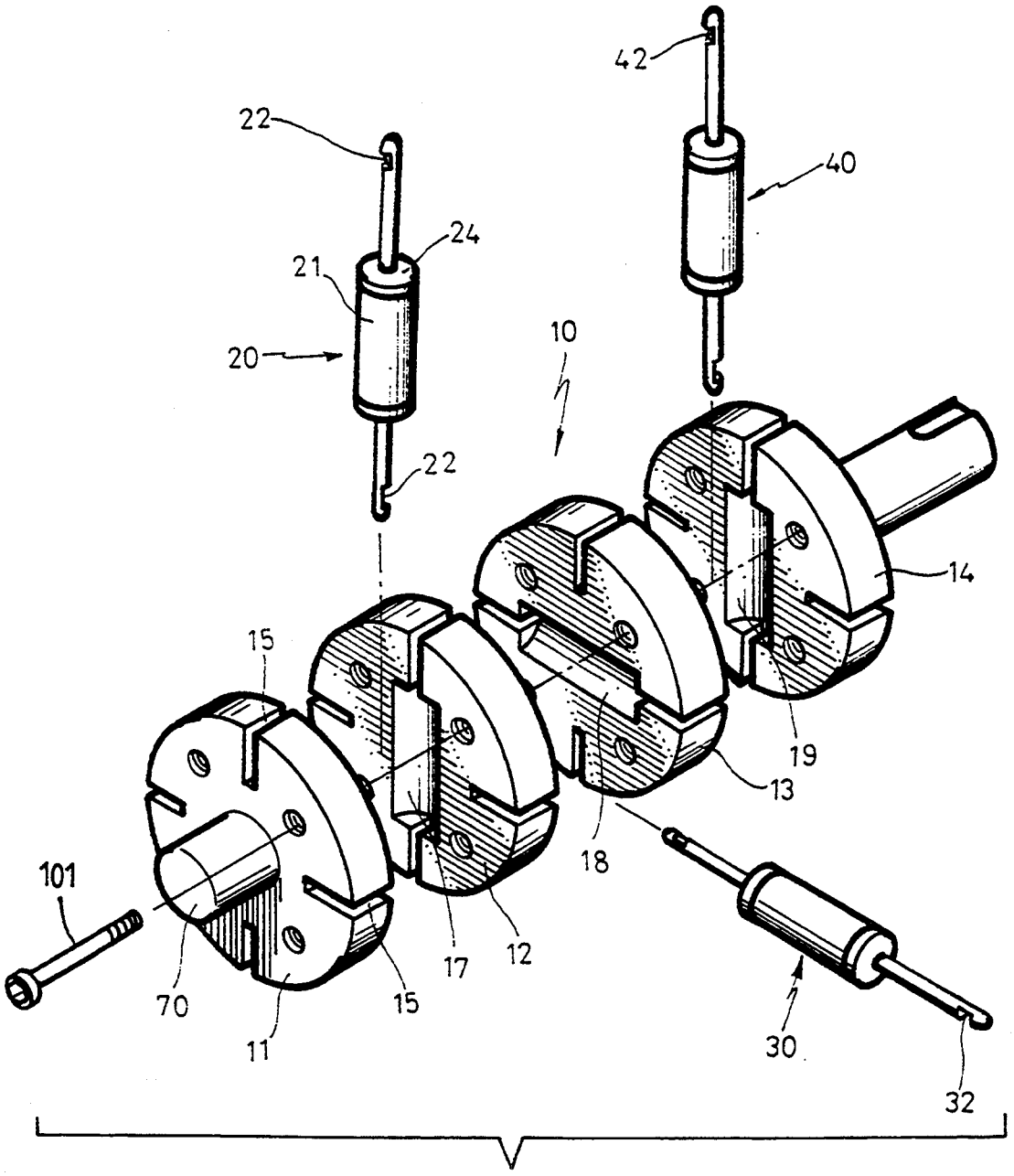
FIG. 1 is a perspective exploded view of a rotor with several links of a vane-type rotary compressor according to this invention.

As shown in FIG. 1, the rotor (10) is constructed by four plates (11), (12), (13), and (14) which are capable of assembling by four dowel screws (101). Four evenly spaced grooves (15) are provided in the exterior cylindrical surface of each plate and each set of the related grooves forms four evenly spaced slots (16) when the plates are engaged together. The inner sides of the plates (11) and (14) are provided with a semi-cylindrical hole and both sides of the plates (12) and (13) are provided with the same. Every two semi-cylindrical holes on adjacent plates form an entire cylindrical hole, and there are three holes (17), (18), and (19) in the rotor (10) while the hole (18) is perpendicular to the other two holes (17) and (19).

Figure 4:
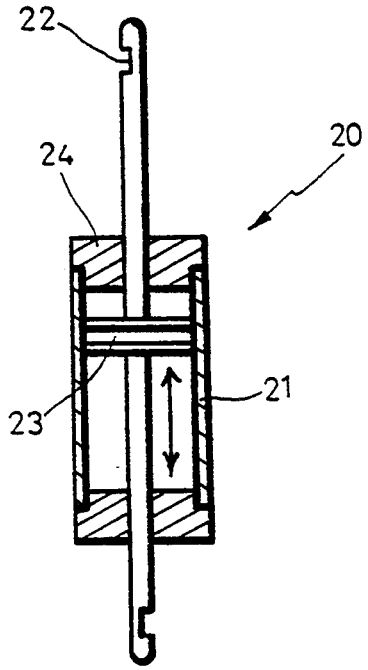
FIG. 4 is a cross-sectional view of a link according to the present invention.

Three links (20), (30), and (40) are provided in the three holes (17), (18), and (19). The link (20) has a central sleeve (21) which is fit to the hole (17) between the plates (11) and (12), and has its two ends being a hook (22) but both hooks opened in opposite direction. In the sleeve (21), there is a piston (23) combined with the link (20). Two ends of the sleeve (21) are sealed by two covers (24) where becomes a closed space with a piston (23) therein, as shown in FIG. 4. The other two links (30) and (40) have the same structure as the link (20).

Figure 5:
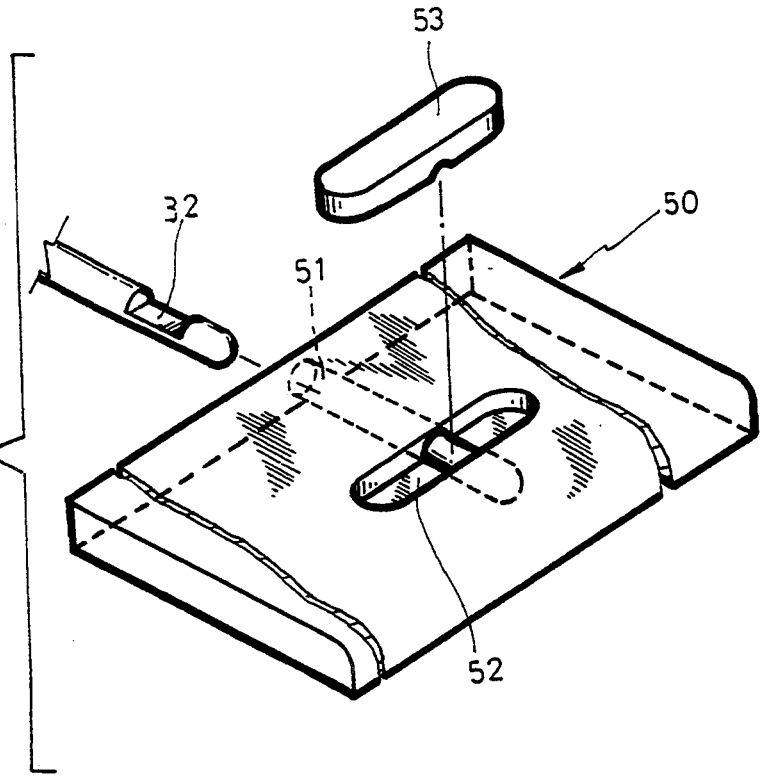
FIG. 5 is a perspective exploded view of a link and a vane according to this invention.
Figure 7:
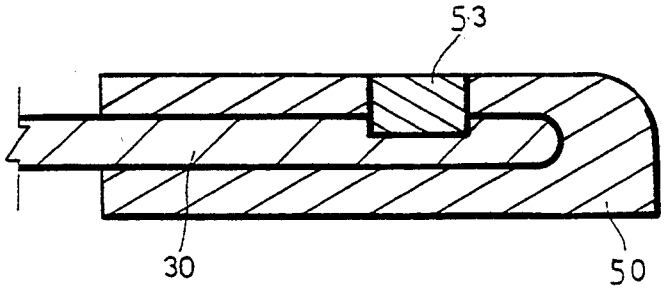
FIG. 7 is a cross-sectional view showing the connection between the link and the vane of the present invention.
Figure 6:
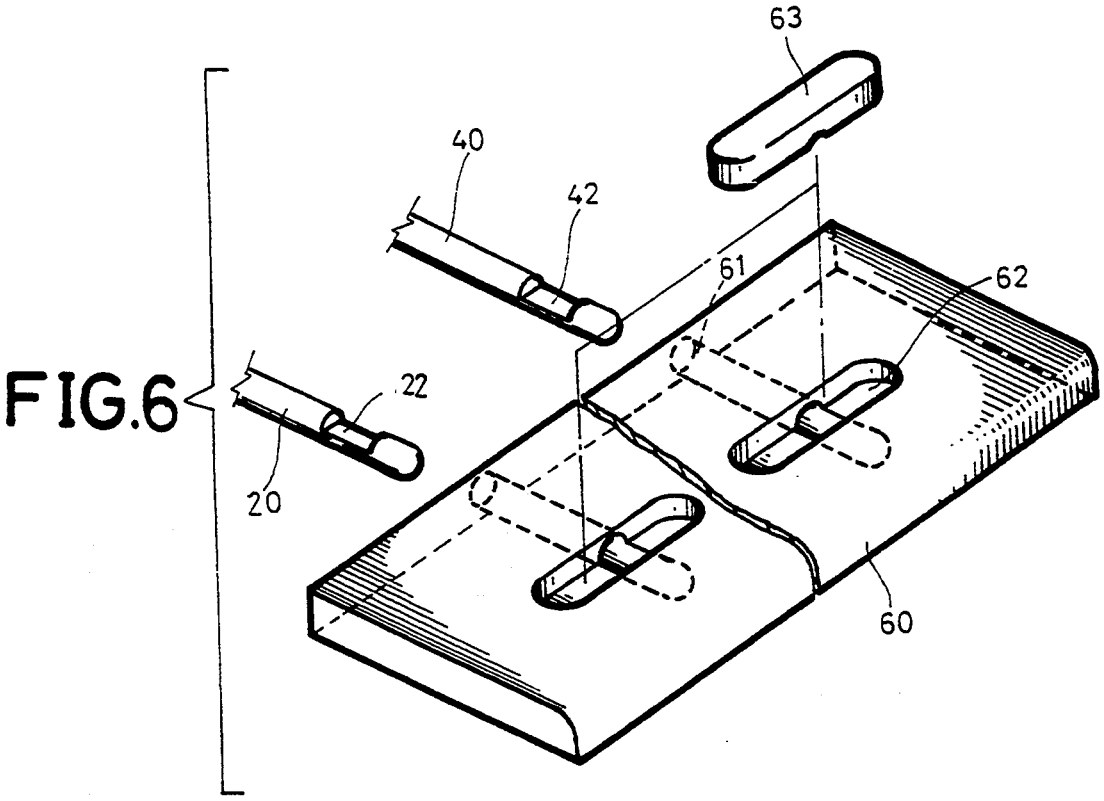
FIG. 6 is a perspective exploded view of two link and another vane according to this invention.

Two pairs of vanes (50) and (60) slidably mounted in the four slots (16). Referring to FIG. 5, a hole (51) and a groove (52) are formed in the vane (50), while one end of the link (30) is inserted into the hole (51) and an engaged key (53) is mounted in the groove (52) to engage with the hook (32) as shown in FIG. 7. The pair of the vanes (50) are engaged with the hooks (32) on both ends of the link (30) and the other pair of the vanes (60) which are provided with two holes (61), two grooves (62), and two keys (63) are engaged with the hooks (22) and (42) of the links (20) and (40), as shown in FIG. 6.

Figure 2:
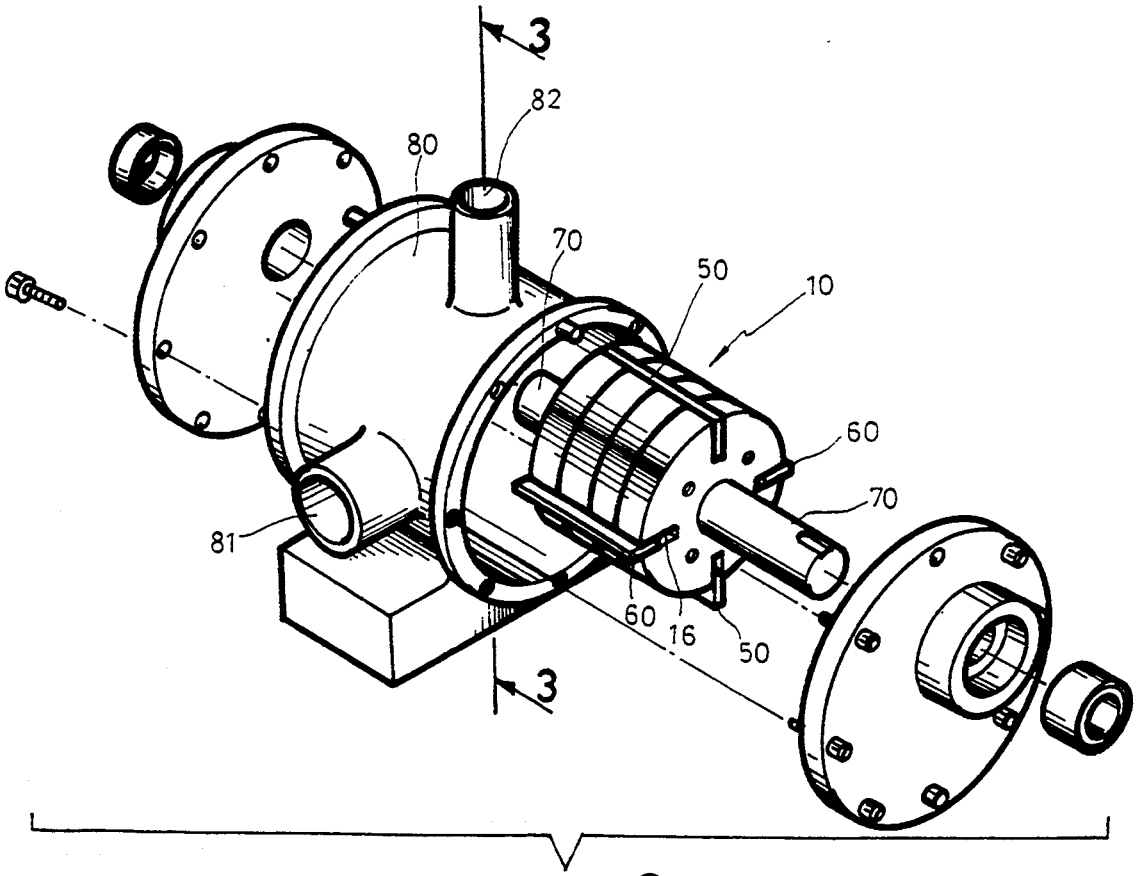
FIG. 2 is a perspective exploded view of a vane-type rotary compressor according to this invention.

As shown in FIG. 2, a shaft end (70) extends from the rotor (10) which is eccentrically mounted in the cylinder (80) having gas inlet (81) and a gas outlet (82) that is similar to a prior art system.

Figure 3:
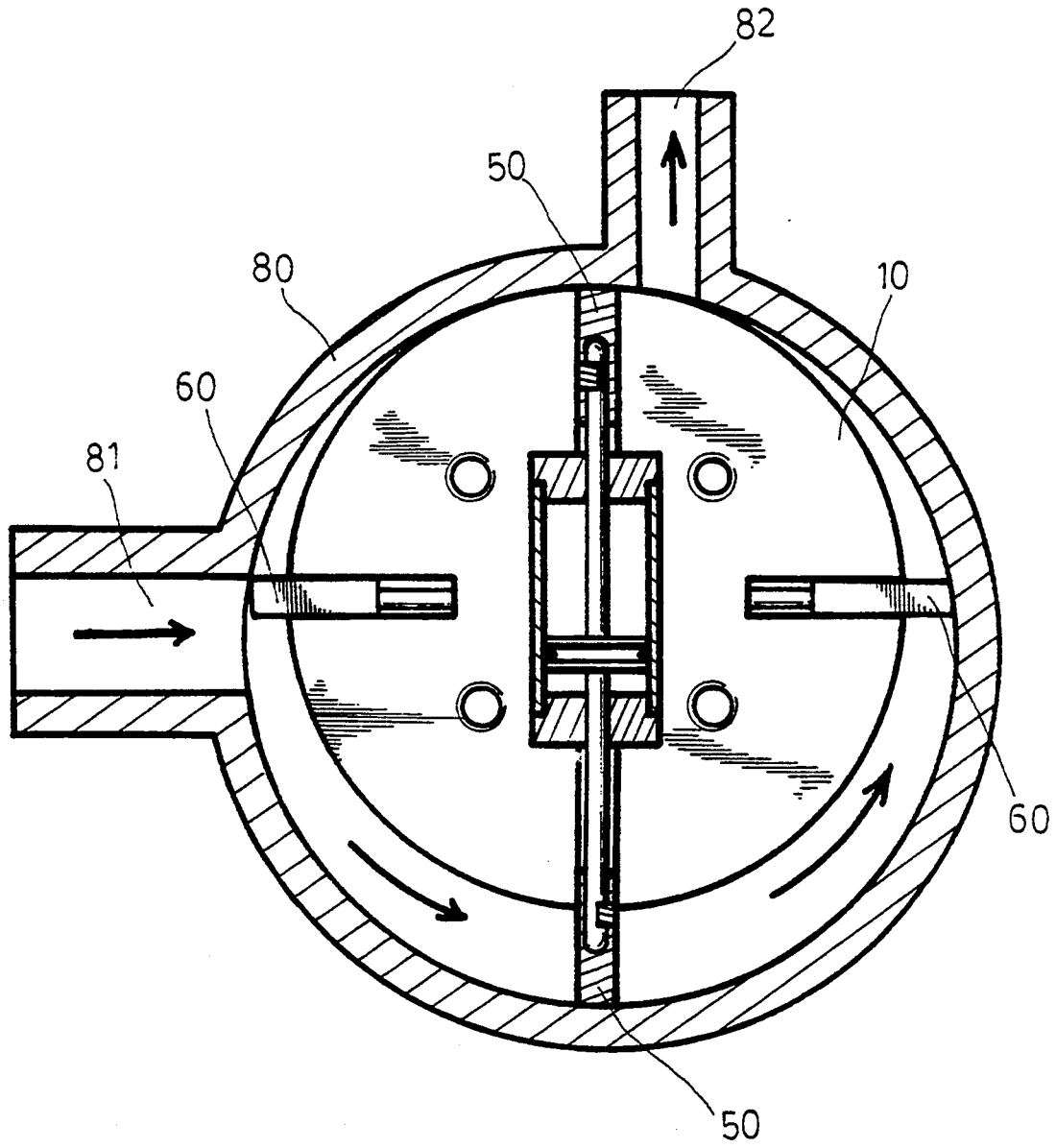
FIG. 3 is a cross-sectional view along line 3—3 of FIG. 2.

In operation, the rotor (10) is rotated and centrifugal force forces the vanes outwardly against the inner surface of the cylinder (80) as shown in FIG. 3. Since at any angular position the total length of a link connecting with two vanes is designed to be equal to the inner "diameter" of the cylinder (80) with a particular non-circle bore, that promises the gas in the space confined by rotor (10), cylinder (80), and the vanes (50) and (60) is sealed until it releases from the outlet (82) during compressing process.

It is the merit of the present invention that in the rotating of the rotor (10), the link with the vanes are sliding smoothly because the piston serves as a buffer. It can offset the centrifugal force produced in the rotation of the rotor which impacts the vanes. The contacting force between the vanes and the cylinder will be negligible and discontinuous, that facilitates the heat dissipation of the vanes tips and reduction of wear.

While the invention has been explained in relation to its preferred embodiments, it is to be understood that various modifications thereof will become apparent to those skill in the art upon reading this specification. Therefore, it is to be understood that the invention disclosed herein is intended to cover such modifications as fall within the scope of the appended claims.

I claim:

1. A vane-type rotary compressor comprising:

(a) a cylinder housing defining a longitudinally directed central axis having a gas inlet conduit and a gas outlet conduit, said cylindrical housing having formed therein a cylindrical housing inner chamber; and, (b) rotor means having a longitudinally directed rotor central axis mounted eccentrically and rotationally within said cylindrical housing inner chamber for eccentric rotation therein, said rotor means including four disk shaped plate members defining a first plate member, a second plate member, a third member, and a fourth plate member, each of said plate members having four radially extending and equally spaced apart grooves extending from an outer peripheral surface of each of said plate members; said four plate members threadedly secured each to the other in aligned relation, said aligned four plate members forming four radially and longitudinally extending and equally spaced apart slots formed therein, said first and fourth plate members respectively having a first and sixth semi-cylindrical recess formed within first surfaces thereof having respectively a first and sixth central axis line direction and in open communication with a first pair of opposing slots, said second plate member having a second and third semi-cylindrical recess formed within opposing surfaces thereof in open communication respectively with said first pair of opposing slots and a second pair of opposing slots, said second semi-cylindrical recess having a central axis line orthogonal to said third semi-cylindrical recess, said third plate member having respectively a fourth and fifth semi-cylindrical recess formed within opposing surfaces thereof and in open communication with said first and second pair of opposing slots, said fourth semi-cylindrical recess having a central axis line orthogonally directed with respect to a central axis line of said fifth semi-cylindrical recess, said first and second semi-cylindrical recesses being aligned each to the other to form a first recess chamber, said third and fourth semi-cylindrical recesses being aligned each to the other to form a second recess chamber, and said fifth and sixth semi-cylindrical recesses being aligned each to the other to form a third recess chamber, and a first, a second and a third piston respectively displaceable within said first, second and third recess chambers, each of said piston members having a central axis with opposing hook members extending on opposing sides thereof and respectively passing through said first and second pair of slots, two pairs of vane members slidingly mounted in said slots and coupled to each of said hook members, said vane members being contiguously positioned with respect to an inner wall of said cylinder housing as said rotor means eccentrically rotates through a portion of a rotative displacement of said rotor means.

* * * * *